United States Patent [19]

Roeder

[11] 3,957,400

[45] May 18, 1976

[54] DOUBLE-ENDED HYDRAULICALLY ACTUATED DOWN-HOLE PUMP

[76] Inventor: George K. Roeder, P.O. Box 4335, Odessa, Tex. 79760

[22] Filed: Oct. 29, 1974

[21] Appl. No.: 518,373

Related U.S. Application Data

[63] Continuation-in-part of Ser. No. 441,801, Feb. 12, 1974, Pat. No. 3,915,595.

[52] U.S. Cl. ..... 417/393

[51] Int. Cl.[2] ..... F04B 17/00

[58] Field of Search ..... 417/393, 397, 401

[56] References Cited

UNITED STATES PATENTS

| | | | |
|---|---|---|---|
| 2,503,986 | 4/1950 | Alley | 417/393 X |
| 2,991,721 | 7/1961 | Foster | 417/393 X |
| 3,212,445 | 10/1965 | Coberly | 417/401 |

*Primary Examiner*—C. J. Husar
*Assistant Examiner*—Leonard Smith
*Attorney, Agent, or Firm*—Marcus L. Bates

[57] ABSTRACT

A downhole fluid actuated pump assembly for use in a borehole. Power fluid flows downhole to an engine which actuates a pump, and the pump lifts production fluid to the surface of the earth, with the spent power fluid from the pump assembly being co-mingled with the production fluid.

The pump assembly has cylinders spaced from one another by a valve assembly with each of the cylinders being divided into upper and lower chambers by a piston, with one side of each piston being used as the engine while the remaining side of each piston is used for pumping formation fluid.

A common connecting rod connects together the pistons and the valve assembly. The interior of the rod is hollow and forms a flow passageway for flow of power fluid to the valve assembly and to a balance tube.

11 Claims, 6 Drawing Figures

DOUBLE-ENDED HYDRAULICALLY ACTUATED DOWN-HOLE PUMP

RELATED PATENT APPLICATIONS

My co-pending patent application Ser. No. 441,801 filed Feb. 12, 1974, now U.S. Pat. No. 3,915,595, of which this patent application is a Continuation-in-Part.

BACKGROUND OF THE INVENTION

Reference is made to the U.S. Pat. Nos. to Roeder 3,703,926; Roeder 3,650,640; Roeder 3,540,814; and Coberly 3,322,069 for further examples of the prior art.

Hydraulically actuated downhole pump assemblies are known to those skilled in the art as evidenced by the above referred to patents, and to the art cited therein, to which reference is made for further background of this invention.

In drilling boreholes to depths exceeding 15,000 feet, it is necessary to reduce the diameter thereof for obvious reasons. Accordingly, when it becomes necessary to utilize a downhole fluid actuated pump assembly in a slim or narrow borehole, it is desirable that the pump assembly have a minimum cross-sectional area so that the pistons contained therein can be fabricated to have a maximum cross-sectional area, thereby pumping a proportionately greater volume of production fluid for each stroke of the pump.

In U.S. Pat. No. 3,650,640, there is taught a pump having a longitudinally extending hollow body member with the interior thereof being divided into upper and lower chambers by a valve assembly. The pump assembly has opposed pistons, one in each chamber, dividing each of the chambers into upper and lower chambers, thereby enabling the valve assembly to be placed within the very closest proximity of the engine cylinder or piston chambers.

In the above copending patent, the use of external passageways formed either through the main body of the pump assembly or the placement of flow conduits externally of the body has been avoided. Both of these expedients significantly reduce the effective cross-sectional area of the engine and the pump pistons. However, it is sometimes desirable to use a downhole pump in a situation which tolerates the presence of external passageways of this type, and such a desirable contribution is the subject of this invention.

SUMMARY OF THE INVENTION

This invention relates to pump apparatus and specifically to a hydraulically actuated downhole pump assembly for an oil well. The pump has a longitudinally extending main body separated into upper and lower main cylindrical chambers which are spaced from one another by a valve assembly. The upper and lower main chambers, respectively, are divided into an upper production chamber, a lower engine chamber, and an upper engine chamber and a lower production chamber by upper and lower pistons reciprocatingly and sealingly received within each of the upper and lower main chambers.

An axially aligned longitudinally extending connecting rod connects together the two pistons and extends through the upper production chamber into a power fluid inlet tube, with the lower extremity of the rod extending through the lower production cylinder and into a rod balance tube. Power fluid flows into the inlet, into the interior of the rod, and to the valve assembly of the engine. Spent power fluid from the valve assembly is conducted directly from the engine where the fluid co-mingles with the produced fluid flowing from the upper and lower production chambers. In carrying out the present invention, improvements in the flow system to and from the engine, and in the valve assembly enhance the operation of the pump assembly.

Accordingly, a primary object of the present invention is the provision of a hydraulically actuated downhole pump assembly having a double acting engine and pump piston with opposite sides of the pistons being utilized as the engine and the pump cylinder chambers.

Another object of the invention is to provide improvements in a valve assembly for use in a hydraulically actuated pump assembly.

A further object of this invention is to disclose and provide improvements in a valve assembly used in combination with a double acting downhole pump assembly wherein the connecting rod controls the action of and provides a flow path of fluid to the valve assembly.

A still further object of this invention is to provide a narrow free type downhole pump assembly which utilizes an axially aligned connecting rod as part of the flow system for flow of fluid to and from the engine.

Another and still further object is to provide improvements in a combination engine and pump assembly and the means by which it is arranged for use downhole in a borehole.

An additional object is to provide improvements in a fixed type hydraulically actuated downhole pump assembly by the provision of a hollow connecting rod which connects together opposed pistons so that the interior of the rod can be used in conducting fluid flow to a control valve assembly.

These and various other objects and advantages of the invention will become readily apparent to those skilled in the art upon reading the following details of description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Throughout the various figures of the drawings, wherever it is logical or convenient to do so, various similar or like parts will be identified by the same or similar numerals.

Figure 1:
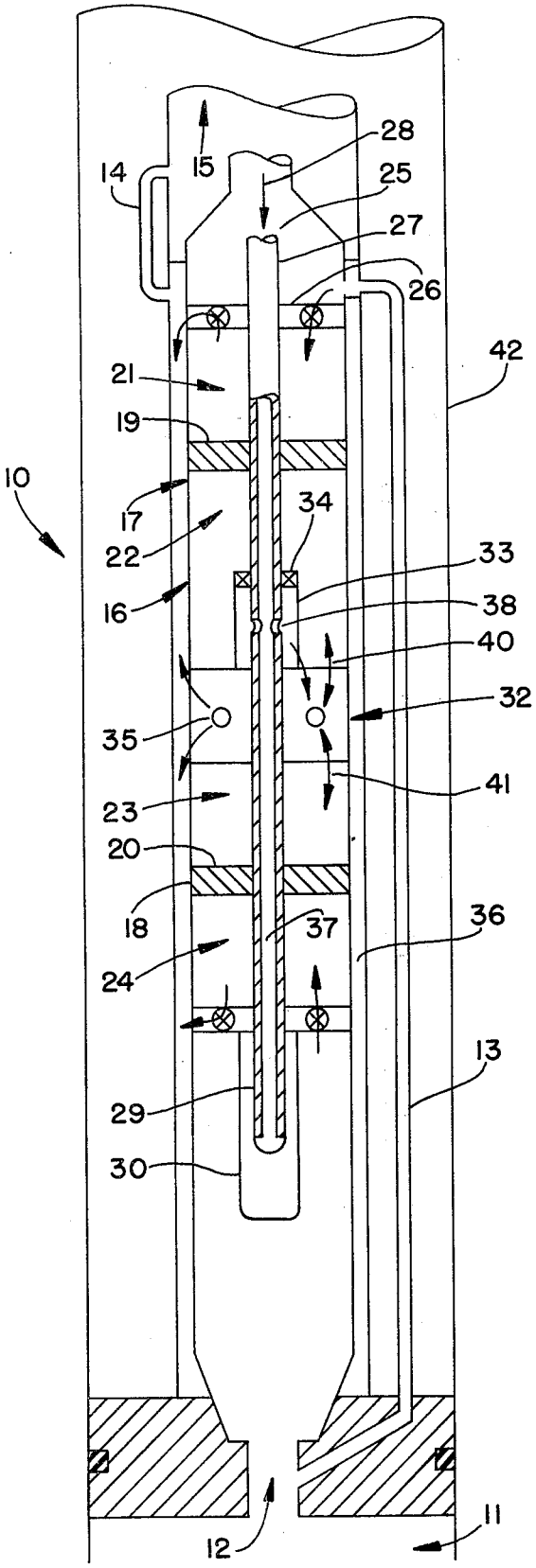
FIG. 1 is a part diagrammatical, part schematical illustration which sets forth the principle of operation of a hydraulic pump diclosed by the instant invention.
Figure 2:
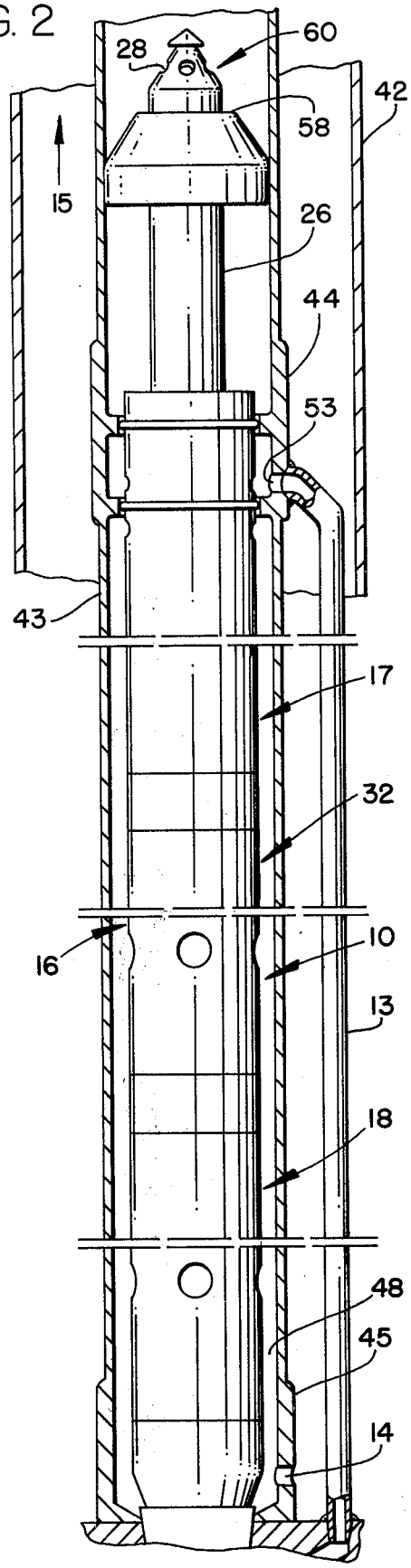
FIG. 2 is a fragmentary, side elevational view of a downhole pump made in accordance with the present invention, with some parts associated therewith being shown in cross-section.
Figure 5:
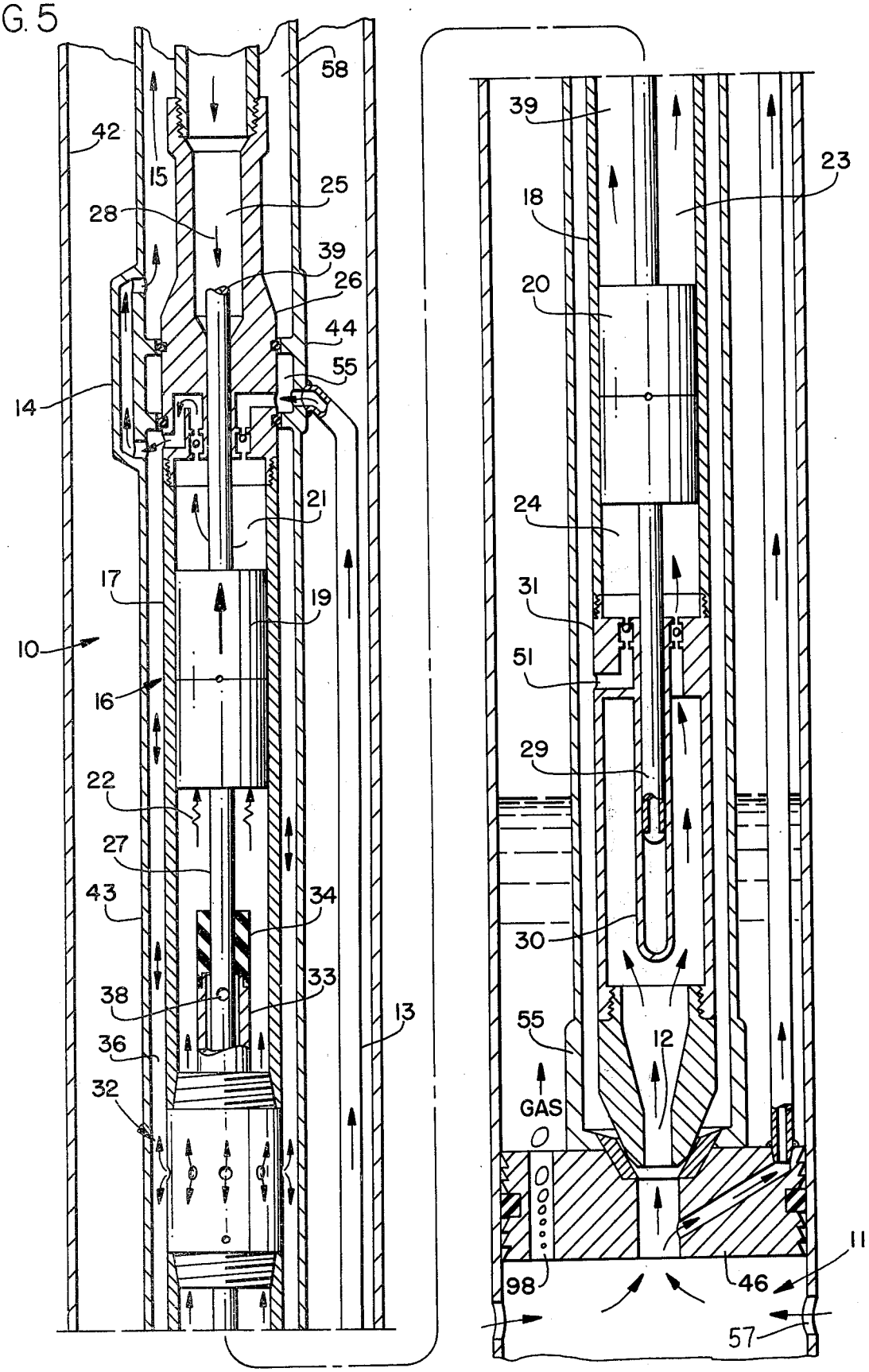
FIG. 5 is an enlarged, fragmentary, cross-sectional view of another embodiment of the pump assembly made in accordance with the invention; and, FIG. 6 is an enlarged, part cross-sectional view of another embodiment of the invention similar to the apparatus disclosed in FIG. 2.

As seen in FIGS. 1, 2, and 5, a fluid actuated downhole pump 10 receives formation fluid at 11 and flow conducts the fluid along path 12 and 13 so that the pump apparatus can cause produced fluid to flow from the pump apparatus at 14 and uphole along flow path 15.

The pump apparatus is comprised of a longitudinally extending main body 16 having an axially extending chamber therein which is divided into an upper chamber 17 and a lower chamber 18 by the illustrated valve assembly. Upper and lower pistons 19 and 20, respectively, divide each of the upper and lower chambers into an upper production chamber 21, a lower engine chamber 22, and upper engine chamber 23, and a lower production chamber 24.

Power fluid inlet chamber 25 is formed by the illustrated housing 26 which slidably receives a marginal end portion of connecting rod 27 in reciprocating manner therein. The entire length of the connecting rod is hollow so that fluid can flow thereinto as indicated by the numeral 28. The lower marginal end portion 29 of the connecting rod is reciprocatingly received in a slidable manner within a balance tube 30 so that fluid is exerted against opposed ends of the rod.

Figure 4:
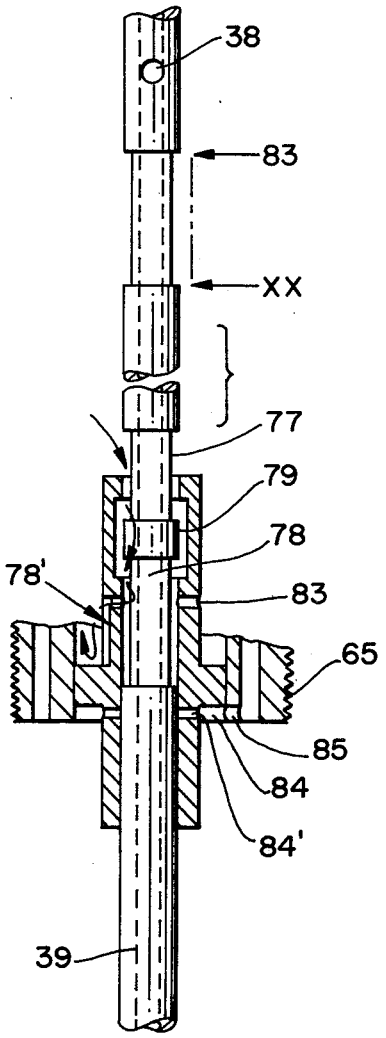
FIG. 4 is a fragmentary, enlarged, part cross-sectional view which sets forth the details of part of the pump apparatus disclosed in the foregoing figure.

The before mentioned valve assembly is seen diagrammatically illustrated by the numeral 32 in FIG. 1, 2, and 5; and is seen in greater detail in FIG. 4 and 4*a*. The valve assembly of FIGS. 1 and 5 is provided with an upwardly directed rod seal tube 33 having seal means 34 at the free end portion thereof. Numeral 37 indicates the central passageway formed along the axial center line of the connecting rod which permits fluid to flow from 25 into the rod at 39, out of the rod at port 38, and into the annulus formed by the rod seal tube. The fluid also continues to flow into the lower portion of the hollow rod, and out of the lower end portion of the rod at 29 into the balance tube.

Fluid transfer passageways 40 and 41 form one flow path from the valve assembly into the lower engine chamber and another flow path into the upper engine chamber.

Hence, it is evident that a power fluid flow path extends from chamber 25 through the hollow rod into the rod seal tube 33 by means of port 38, and to the valve assembly. A spent power fluid flow path is formed from the valve assembly at 35 into the annulus 36 where the spent power fluid co-mingles with the production fluid and flows uphole to the surface of the ground.

The valve assembly alternately connects the power fluid source to flow path 40 and the spent power fluid to flow path 41 thereby causing the upper and lower pistons to reciprocate within the upper and lower cylindrical chambers. This action causes formation fluid to flow into and out of the production cylinders 21 and 24, in response to movement of the pistons. The action of the connecting rod as it reciprocates within the pump assembly causes the valve assembly to shift, thereby alternately connecting together each of the alternate passageways in a cyclic manner.

Figure 6:
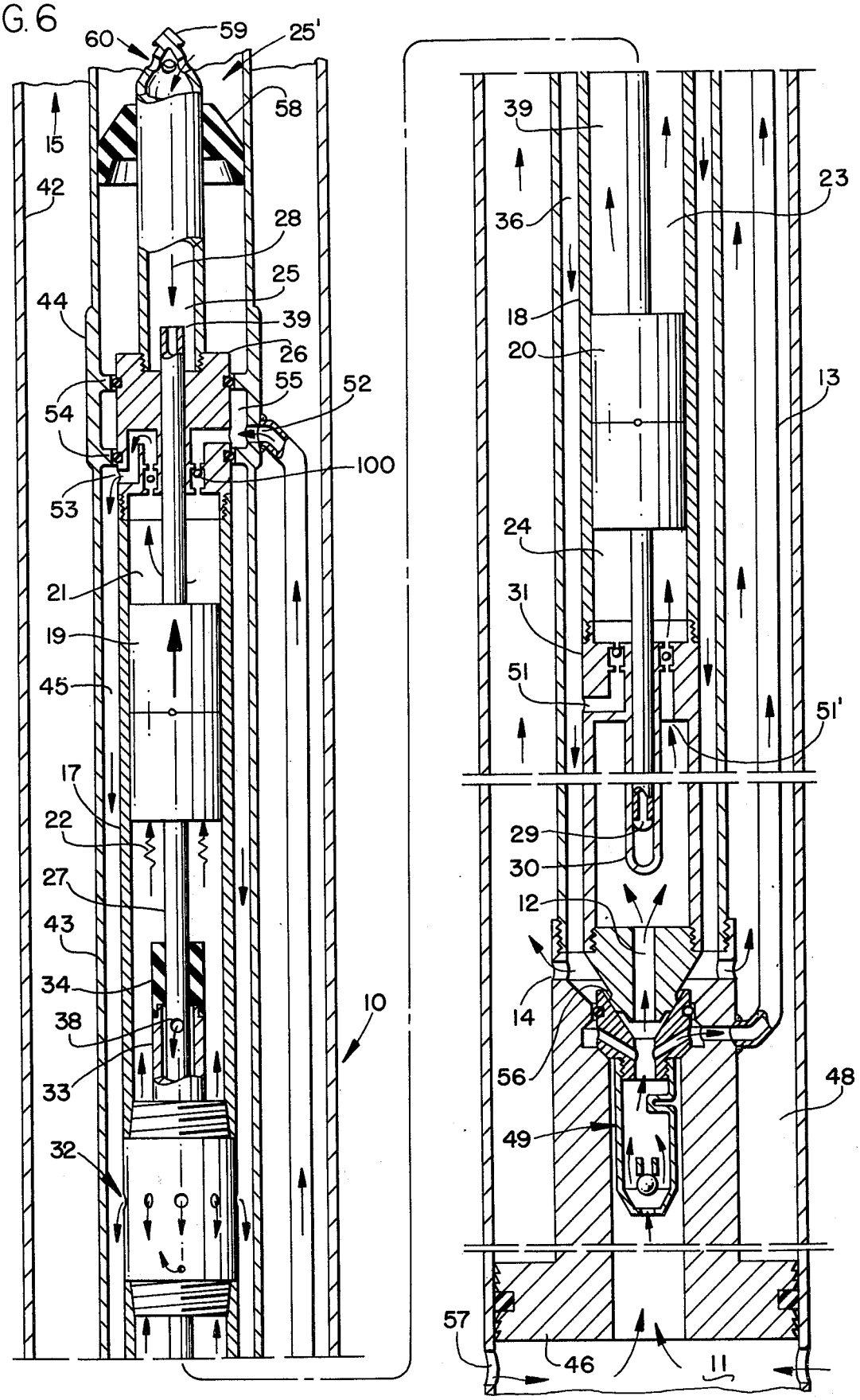

Looking now to the details of the specific embodiment illustrated in FIGS. 2 and 6, and in particular to FIG. 6, wherein one embodiment of the foregoing inventive concept of a free downhole pump is set forth in greater detail. As particularly seen illustrated in FIG. 6, casing 42 of a well bore is concentrically arranged relative to production tubing 43, and the production tubing is provided with seal means 44 for maintaining various fluids separated from one another as will be dicussed in greater detail later on in this disclosure.

A packer device 46 isolates a source of formation fluid 57 from casing annulus 48 and tubing annulus 36. A foot valve assembly 49 precludes flow passsageways 36 and the fluid producing reservoir when the free type pump, for example, is removed therefrom.

The lower seal assembly of FIG. 6 is provided with a port 14 so that produced fluid can flow into annulus 48 and to the surface of the ground. Inlet port 51 is connected to supply production fluid to the lower production chamber 24, while inlet port 52 is connected to supply production fluid to the upper production chamber 21. Production outlet port 53 enables produced fluid to flow from chamber 21 into the annulus 36.

The upper seal has spaced circumferentially extending seal means 54 which sealingly engage an upper marginal outer surface area of the main body of the pump, thereby isolating the power fluid source 25' from the production tubing annulus. A lower seal means 56 formed on the lower marginal end of the pump isolates the inlet of the pump from the tubing annulus.

The casing is perforated at 57 in the usual manner so that production fluid can flow into the chamber 11. Packer element 58 enables the pump assembly to be forced into and out of the borehole. Fishing neck 59 forms the uppermost end of the pump while power fluid can flow into the pump assembly by means of the ports indicated by the numerals 60.

Figure 3:
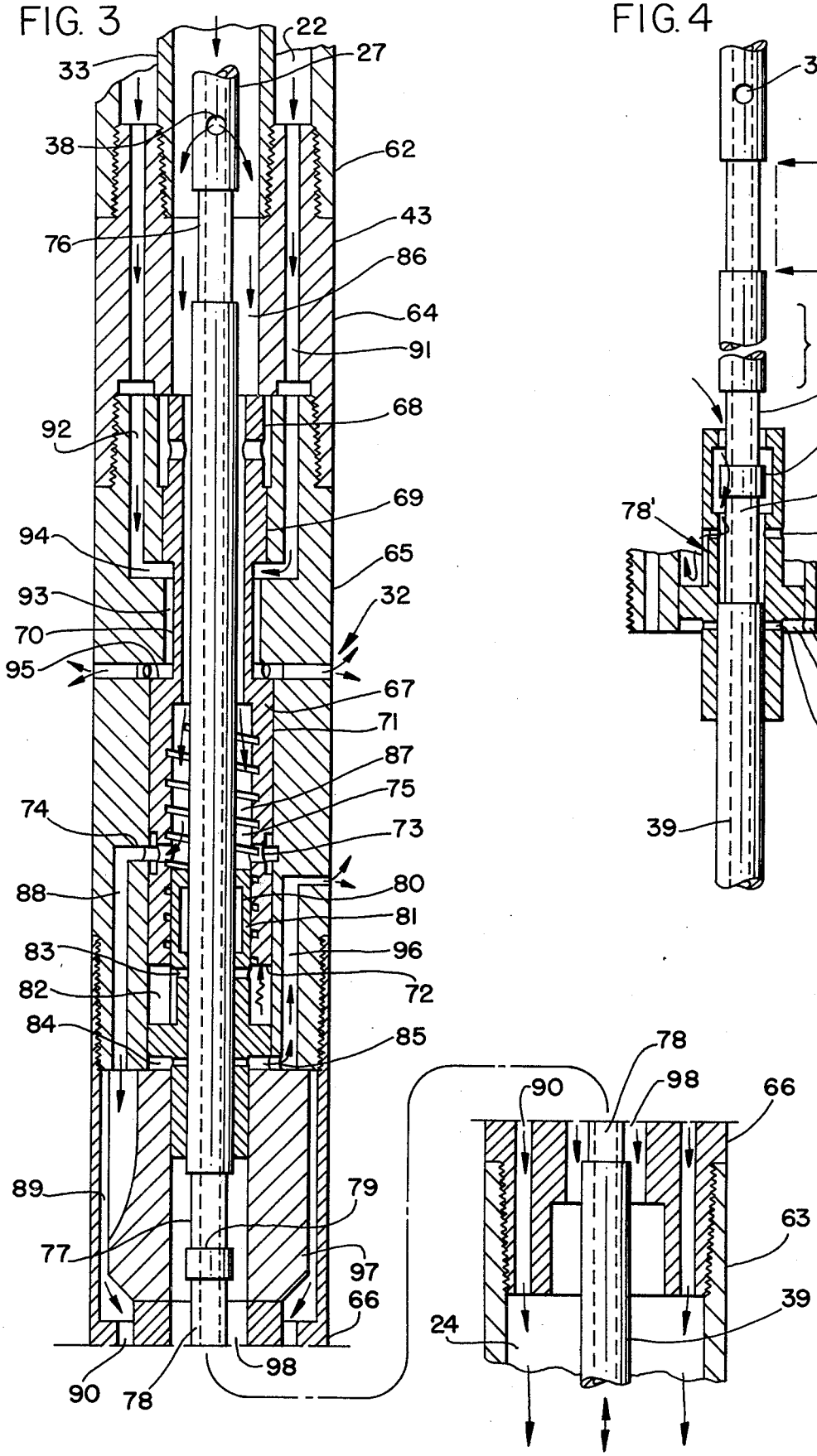
FIG. 3 is an enlarged, longitudinal, part cross-sectional illustration of part of the pump assembly disclosed in the foregoing figures.

FIGS. 3 and 4 set forth the constructional details of the valve assembly previously disclosed in the foregoing figures. The upper marginal portion of the main body is formed into an upper cylinder 62 with the lower end of the cylinder being threadedly attached to adapter 64 which in turn is threadedly affixed to a valve body 65. Lower adapter 66 threadedly engages the lower cylinder 63 and has a longitudinally extending axially aligned passageway formed therethrough of varying diameters so that a sliding valve element 67 can be reciprocatingly received therewithin with the control rod, valve element, and valve body all being concentrically arranged relative to one another.

The sliding valve element has an upper reduced portion 68 which enlarges at 69, reduces in diameter at 70, and again enlarges in diameter to form a downwardly opening skirt member 71 having a lower terminal end portion 72. Radially spaced ports 73 may be placed in fluid communication with port 74 and annular chamber 75.

The connecting rod is provided with upper and lower circumferentially extending undercut areas 76 – 78, hereinafter called upper and lower flats. The upper flat 76, when the pistons downstroke, is arranged to cause the valve element to shift in a downward direction, while the lower flat, when the pistons upstroke, is adapted to cause the valve element to shift in an upward direction. Undercut area 77 communicates chamber 75 with annular groove 80 of member 81, while undercut area 78 communicates the annular groove 80 with chamber 82. Hence, it is apparent that the annular interior groove 80 of fixed sleeve member 81 enables flow to occur across the marginal length 79 of the connecting rod.

The lower marginal outer surface area of the fixed sleeve 81 is rigidly but removably connected to the sub 66. Ports 83, 85, and annular exhaust chamber 84 provide for controlled flow of fluid for actuating the sliding valve element.

Annular power fluid flow passageway 86 is in fluid communication with annular flow passageway 87 formed between the rod and the skirt and provides a source of power fluid to flow passageway 88 when ports 73 and 74 are aligned with one another. Passageway 88 is connected to the lower engine chamber by means of passageways 89 and 90.

Radial flow passageways 91 continue through the sub as passageways 92 and flow through the annulus 93 formed between the reduced portion of the traveling valve element and the valve body so as to place ports 94 and 95 in fluid communication with one another when the valve element is in the uppermost position. The fluid flows out of exhaust port 95 and into the tubing annulus. Exhaust port passageway 96 can be connected as shown or tied into exhaust port 95.

Hence, it is evident that the valve assembly of FIG. 3 alternately connects together a source of power fluid at 86 and one of the engine cylinder flow passageways 90 and 91 leading to one of the engine cylinders, and at the same time a spent power fluid outlet port 32 is connected to the remaining one of the engine cylinder flow passageways so that one of the engine chambers is exhausting spent power fluid while the other chamber is being filled with power fluid, thereby causing the double acting engine to continue to stroke in each direction.

In operation of the embodiment of the invention disclosed in FIGS. 2 and 6, power fluid flows downhole through tubing 43 and into the packer nose assembly at 60, with the fluid continuing into the upper terminal end of the connecting rod as indicated by the numeral 28. The power fluid flows at 28 and into the interior of the connecting rod at 39, through the upper seal means 26, through the upper production cylinder, the upper piston, through the lower engine cylinder, into the upper rod seal tube, and out the power fluid outlet 38 formed within the connecting rod. The interior passageway formed within the connecting rod is continuous and therefore fluid is free to flow into the balance tube 30.

As seen in FIG. 3 together with FIGS. 2 and 6, power fluid continues to flow through annulus 86 where it is available to the valve assembly which causes it to alternately flow into one or the other of the engine cylinders. With the traveling valve element in its uppermost position, the power fluid continues to flow into annulus 87, ports 73 and 74, passageway 88, 89, and 90, and into the lower engine chamber 24, thereby stroking the pistons in a downward direction.

As the pistons stroke in a downward direction, the spent power fluid located within the upper engine cylinder 22 flows into the radial passageways 91 and 92, annular passageway 93, and into the outlet passageway 95 where the fluid exhausts at numeral 32. The spent power fluid co-mingles with the production fluid from the upper production chamber and flows on through the tubing annulus to mix with produced fluid at 51. The flow continues through port 14 and into the casing annulus.

One important feature of the present invention is the presence of the spaced dual adjacent lower valve shifting grooves 77 and 78, best seen in FIG. 4. As the lower grooves, which are spaced apart by shoulder 79, are moved into the up position, that is, when the control rod shifts up, fluid will flow from chamber 75 into the upper extremity of the upper groove, down the groove, and into the annular groove 80, across the shoulder 79, into the upper extremity of groove 78, and into the annular chamber 82, thereby enabling high pressure fluid to flow under the traveling valve element causing the valve to shift into the illustrated upper position of FIG. 4. In the absence of the shoulder 79, the seal provided by the control sleeve 81 will be shorted out, thereby letting the valve element shift back into the down position, as undercut areas 77 and 78 pass 83 and 84.

As the pump downstrokes, the upper groove 76 interconnects annular chamber 82 with chamber 84, thereby permitting fluid within chamber 82 to flow across the groove, into chamber 84, through port 85, and into the passageway 96 where the fluid is exhausted. This action enables the high pressure fluid which is effected upon the uppermost surfaces of the valve element to force the element to move in a downward direction until edge portion 95 is moved below port 74, thereby communicating ports 74 and 95 with one another. This enables fluid from chamber 24 to be exhausted through passageway 90, 89, 88, 74, 95, and 32.

In operation of the embodiment of FIG. 5, the fixed type downhole hydraulically actuated pump assembly is placed downhole attached to the end of the production tubing and operated in the illustrated manner of FIGS. 1, 3 and 5. Power oil input into the upper extremity of the hollow connecting rod at 39 enables the power fluid to flow into the interior of the rod, through the upper piston, out of the hollow connecting rod at 38, into the upper seal tube annulus, and to the valve assembly so that the valve assembly can alternately provide the power side of the spaced engine cylinders with power fluid, thereby causing the production pistons to reciprocate within the production cylinders.

Formation fluid at 11 flows into the lower production cylinder at inlet 12, and into the upper production cylinder by means of passageway 13 and annulus 55. Produced fluid flows from each of the production chambers and into the tubing annulus where it admixes with spent power fluid from ports 95 and 96. Crossover 14 is required to circumvent the annulus 55 and seal assembly 44.

In FIG. 5, the lowermost end of the pump sealingly engages the seat formed on the end of the tubing, and the end of the tubing sealingly engages the packer device 46, thereby isolating the various flow streams from one another. Gas outlet 98 enables venting of the compressibles into the casing annulus.

The pump of FIG. 5 is used where a slim pump assembly is not required, and where a fixed type pump is desired. The pump is run into and out of the casing in the usual manner.

I claim:

1. A downhole hydraulically actuated pump assembly having an engine means, a pump means, a connecting rod attached to said pump means and engine means such that said engine means moves said connecting rod from a downstroke position to an upstroke position, thereby enabling the engine means to actuate the pump means; means, including a control valve, by which power fluid can flow to and from the engine means to thereby enable the pump means to be actuated;

said control valve comprises a valve body, a control sleeve, a valve element located within said valve body and slidably received about said control sleeve such that said valve element can be moved from a lower to an upper position; said valve body, valve element, and control sleeve being concentrically arranged about said connecting rod;

spaced upper and lower flats on said connecting rod; means forming a power fluid annulus between said connecting rod and valve element, means forming a spent power fluid outlet; means forming a variable chamber between said valve body, control sleeve, and valve element for causing said valve element to reciprocate when power fluid is connected thereto; an annular chamber formed between said connecting rod and the interior of said control sleeve, flow passageway means formed in said valve body and connected to said engine means;

said lower flat being comprised of two spaced undercut areas of a length to connect together said power fluid annulus, said annular chamber, and said variable chamber when said connecting rod is in an upstroke position, to cause said valve element to shift upward thereby enabling the valve means to connect said power fluid and said spent power fluid flow passageways of the engine means in a manner to cause the connecting rod to stroke downwards;

means, including a spiral groove formed on the inside wall surface of said valve element, by which said upper flat connects together said variable chamber and said power fluid outlet when the connecting rod downstrokes, for shifting the valve element downward, thereby connecting together said power fluid and said spent power fluid flow passageways of the engine means in a manner to cause the connecting rod to stroke upwards.

2. A hydraulically actuated downhole pump assembly comprising a main body having upper and lower cylindrical chambers spaced from one another by a control valve assembly;

said upper and lower cylindrical chambers, respectively, having upper and lower pistons, respectively, reciprocatingly received therein; a hollow connecting rod connected to said upper and lower pistons and adapted to stroke with the pistons in either of two opposed directions, a marginal intermediate portion of said connecting rod being received through said control valve; means by which reciprocal action of said rod controls the action of said control valve;

said upper piston dividing said upper cylinder chamber into an upper production chamber and a lower engine chamber;

said lower piston dividing said lower cylinder chamber into an upper engine chamber and a lower production chamber;

a balance tube, a marginal free lower end portion of said hollow rod being received within said balance tube;

means including a flow conduit forming a formation fluid inlet through part of said main body and into said upper and lower production chambers so that formation fluid from a production formation can flow thereinto; means including a flow conduit forming a produced fluid outlet through part of said main body and from said upper and lower production chambers so that produced fluid can flow from said downhole pump;

a seal tube connected to said control valve assembly, a port formed in said rod; a marginal length of said rod, including said port, being received in spaced relation within said seal tube;

means forming a power fluid flow path which extends into said main body, into said hollow rod, through said upper piston, through a marginal length of said connecting rod to said port formed within said rod where the fluid branches into two paths and one path flows into said rod seal tube and to said control valve assembly while the other flow path continues through the hollow rod and into said balance tube;

means forming a first transfer fluid flow path connected from said control valve to said lower engine chamber; means forming a second transfer fluid flow path connected from said control valve to said upper engine chamber;

means forming a spent power fluid flow path connected to flow from said control valve, into flow communication with said produced fluid outlet;

and means responsive to reciprocal movement of said connecting rod for causing said control valve to connect said first transfer fluid flow path to said power fluid flow path, and said spent power fluid flow path to said second transfer fluid flow path when said rod strokes in one of two directions; and, to connect together said second transfer fluid flow path to said power fluid flow path, and said spent power fluid flow path to said first transfer fluid flow path when said rod strokes in the other of two directions;

so that fluid pressure alternately effected in said lower and upper engine chambers causes produced fluid to flow from said upper and lower production chambers.

3. The downhole pump of claim 2 wherein said control valve includes a traveling element slidably received therein and slidable from a first to a second position for properly aligning the recited passageways together so that the fluid flow can occur therethrough.

4. The pump of claim 2 wherein said means responsive to reciprocal movement of said connecting rod includes a traveling element slidably received within said control valve and slidable from a first to a second position for aligning the various flow passageways together.

5. The pump assembly of claim 2, and further including a packer nose assembly affixed to an upper end of said pump through which power fluid flows into said pump;

seal means formed on the lower end of said pump by which the formation fluid inlet is isolated from the produced fluid outlet;

a foot valve assembly having a check valve therein through which formation fluid flows to said pump; said lower end of said pump sealingly engaging said foot valve.

6. The pump assembly of claim 5, wherein there is provided a cased borehole having a central tubing disposed therein, a packer device connecting the central tubing to the casing; said foot valve being interposed between said casing and said tubing so that check valve precludes flow between the casing annulus, the production formation, and the interior of the tubing;

an outer passageway means connected from said upper production cylinder to a location downstream of said check valve and upstream of the pump inlet so that formation fluid flows into each of said production cylinders.

7. The pump assembly of claim 6 wherein there is provided spaced seal means on the interior of said central tubing which sealingly engages an upper marginal end of said pump body and forms an annulus therebetween, said outer passageway means being flow connected to the last said annulus; said upper production cylinder being connected to the last said annulus;

so that separate marginal lengths of the central tubing forms isolated flow paths for power fluid, formation fluid, and exhaust fluid and produced fluid.

8. In a downhole hydraulically actuated pump assembly having a fluid powered engine connected to drive a production pump, and a source of power fluid connected to the engine, with the production pump being connected to a source of formation fluid, and with the pump assembly being connected so that spent power fluid and produced fluid flows uphole to the surface of the ground, the improvement comprising:

said pump assembly comprising a main body having means forming an upper cylinder chamber, a lower cylinder chamber, a control valve, with said upper and said lower cylinder chambers being spaced from one another by said control valve;

a hollow connecting rod having an axial passageway formed therethrough, an upper and lower production seal means, an upper piston, a lower piston, said upper piston dividing said upper chamber into an upper production chamber and a lower engine chamber; said lower piston dividing said lower chamber into an upper engine chamber and a lower production chamber; said connecting rod being connected to said pistons and extending through said upper production seal means, said upper production chamber, said upper piston, said lower engine chamber, said control valve means, said upper engine chamber, said lower piston, said lower production chamber, and through said lower production seal means;

a seal tube means flow connected to said valve and extending into said lower engine chamber; said lower production seal means being separated from said lower piston by said lower production chamber; said upper production seal means being separated from said upper piston by said upper production chamber;

means forming a first transfer flow passageway from said valve into said lower engine chamber, means forming a second transfer flow passageway from said valve into said upper engine chamber;

means forming a power fluid flow passageway extending from the interior of an upper end of said pump, into the upper end of said rod, through a marginal length of said rod, into said seal tube means and to said valve; means forming a spent power fluid flow passageway from said control valve;

said control valve including means responsive to movement of said rod in one direction for causing said first transfer flow passageway to be connected to said power fluid flow passageway while said second transfer flow passageway is connected to said spent power fluid flow passageway; and, means responsive to movement of said rod in another direction for causing said first transfer flow passageway to be connected to said spent power fluid flow passageway while said second transfer flow passageway is connected to said power fluid flow passageway.

9. The downhole pump of claim 8 wherein said control valve includes traveling element slidably received therein and slidable from a first to a second position for properly aligning the recited passageways together so that fluid flow can occur therethrough.

10. The downhole pump of claim 8 wherein said power fluid path includes said seal tube means which has a marginal length of said connecting rod axially positioned therewithin; the outer surface of said marginal length of said rod being spaced from the inner surface of said seal tube means to form an annulus therebetween; a port in the last said marginal length of said rod communicating said annulus with the interior of said rod;

said annulus of said seal tube means forming part of said power fluid flow path.

11. The downhole pump of claim 8 wherein said control valve includes a valve body, said means responsive to movement of said rod includes a traveling valve element concentrically arranged and slidably received respective to said valve body and said connecting rod;

means by which said first and second transfer flow passageways, and said power and spent fluid flow passageways are alternately connected together by the action of said traveling valve element as it reciprocates within said valve body.

* * * * *

UNITED STATES PATENT OFFICE

CERTIFICATE OF CORRECTION

PATENT NO. : 3,957,400

DATED : May 18, 1976

INVENTOR(S) : George K. Roeder

It is certified that error appears in the above-identified patent and that said Letters Patent are hereby corrected as shown below:

Claim 3, Column 8, line 45, cancel "the".

Claim 6, Column 8, line 67, insert --said-- before "check valve".

Claim 9, Column 10, line 26, insert --a-- after "includes".

Claim 10, Column 10, line 31, insert --flow-- after "fluid".

Signed and Sealed this

Fifth Day of October 1976

[SEAL]

*Attest:*

RUTH C. MASON
*Attesting Officer*

C. MARSHALL DANN
*Commissioner of Patents and Trademarks*